US005779498A

United States Patent [19]

Asakawa

[11] Patent Number: 5,779,498

[45] Date of Patent: Jul. 14, 1998

[54] FLAT CABLE CONNECTOR

[75] Inventor: Kazushige Asakawa, Yokohama, Japan

[73] Assignee: The Whitaker Corporation, Wilmington, Del.

[21] Appl. No.: 841,294

[22] Filed: Apr. 29, 1997

Related U.S. Application Data

[63] Continuation of Ser. No. 537,602, Nov. 27, 1995, abandoned.

[30] Foreign Application Priority Data

Oct. 31, 1994 [JP] Japan ..... 6-266608

[51] Int. Cl.[6] ..... H01R 9/07

[52] U.S. Cl. ..... 439/495; 439/77

[58] Field of Search ..... 439/495, 67, 77, 439/60, 83, 492, 493, 494, 496, 498, 499, 636, 329, 259–267, 637

[56] References Cited

U.S. PATENT DOCUMENTS

| | | | |
|---|---|---|---|
| 3,154,365 | 10/1964 | Crimmins | 439/496 |
| 3,805,213 | 4/1974 | Austin | 439/77 |
| 3,887,260 | 6/1975 | Codrino | 439/496 |
| 4,718,859 | 1/1988 | Gardner | 439/493 |
| 4,734,053 | 3/1988 | Imai | 439/329 |
| 4,815,990 | 3/1989 | Ristedt et al. | 439/498 |
| 4,959,030 | 9/1990 | Tatebe et al. | 439/67 |
| 5,106,311 | 4/1992 | Yodogawa et al. | 439/495 |
| 5,316,486 | 5/1994 | Tanaka et al. | 439/496 |
| 5,316,496 | 5/1994 | Imai | 439/495 |
| 5,385,478 | 1/1995 | Niekawa | 439/495 |
| 5,496,180 | 3/1996 | Fabian et al. | 439/60 |
| 5,525,071 | 6/1996 | Obara et al. | 439/636 |
| 5,622,505 | 4/1997 | Hashiguchi et al. | 439/67 |

FOREIGN PATENT DOCUMENTS

| | | | |
|---|---|---|---|
| 0 259 964 A1 | 3/1988 | European Pat. Off. . | |
| 2 577 353 A1 | 8/1986 | France . | |
| 2149180 | 10/1970 | Germany | 439/496 |
| 61-13182 | 6/1986 | Japan . | |
| 64-13682 | 3/1988 | Japan . | |
| 406132057 | 5/1997 | Japan | 439/499 |

*Primary Examiner*—P. Austin Bradley
*Assistant Examiner*—Tho Dac Ta
*Attorney, Agent, or Firm*—Robert Kapalka

[57] ABSTRACT

The object of the present invention is to reduce housing size and make it possible to provide connections between connecting members of a flat cable and electrical terminals at a high density in a limited housing space, while minimizing the number of flat cables mounted in the housing and keeping flat cable manufacturing costs down. The flat cable connector 10 comprises a housing 20 which accommodates and holds a plurality of electrical terminals 30, a slider member 40 which is supported on the housing 20 so that the slider member 40 can slide back and forth, and a flat cable 50 which is positioned in the housing 20 and connected with the terminals 30. The flat cable 50 has a plurality of connecting members or pads 51 which are lined up along an edge of one end portion of a flexible sheet-base member 51 and is constructed to be used in a folded state by which the flat cable 50 is folded along a center with respective terminals 30 inside the housing 20 being located in positions corresponding to the respective connecting members 52 of the flat cable 50 so as to be electrically connected therewith when the flat cable containing the connecting members is positioned within the housing.

9 Claims, 5 Drawing Sheets

FLAT CABLE CONNECTOR

This application is a Continuation of application Ser. No. 08/537,602 filed Nov. 27, 1995, now abandoned.

FIELD OF THE INVENTION

The present invention is directed to an electrical connector and more specifically concerns a flat cable connector in which a flexible sheet flat cable, such as an FPC (flexible printed circuit), is used as electrical wiring.

BACKGROUND OF THE INVENTION

Generally, flat cables such as FPC's, etc., have a flexible sheet base member which is formed in the shape of a band, a plurality of connecting members, which are installed at prescribed intervals along the edge of one end portion of the base member and a circuit section which extends from the connecting members to the other end portion of the base member.

In flat cable connectors which use a flat cable as electrical wiring, as is disclosed in Japanese Patent Application NO. 61-131382 and Japanese Utility Model Application No. 64-13682, a plurality of electrical terminals, which are connected at one end to the connecting members of the flat cable and which are connected at the other end to the connecting members of a printed circuit board, are accommodated and held inside a housing. A receiving section which receives one end of the flat cable is formed inside the housing, and one end portion of each of the terminals is exposed inside the receiving section. One end portion of the flat cable is inserted into the receiving section of the housing, and the respective connecting members of the flat cable make electrical connection with contact sections of the terminals. Generally, flat cable connectors are equipped with a slider member which is inserted into a receiving section of the housing together with one end portion of the flat cable and which presses the connecting members of the flat cable against the contact sections of the terminals in order to insure a good electrical connection between the connecting members of the flat cable and the terminals.

In recent years, however, along with an increasing demand for miniaturization in electronic devices; there has also been a demand in flat cable connectors for reduced housing size, high density installation of numerous terminals in the housing, thereby resulting in close spacing between the connecting members of the flat cable and the contact sections of the terminals in a limited space. In order to respond to this demand, it is desirable to install numerous connecting members at close spacing on flat cables. However, the widths of the respective connecting members cannot be reduced below a prescribed value which is required in order to prevent faulty or erroneous connections with the terminals. Furthermore, the spacing between respective connecting members must also be maintained in order to prevent faulty connections. Accordingly, in the case of structures in which numerous connecting members are provided in a single row at one end on one side of the base member of the flat cable and in which numerous terminals inside the housing are similarly located in a single row in positions corresponding to the respective connecting members of the flat cable, there are limits to the extent to which the size of the housing can be reduced, and it is difficult to maintain the alignment between the connecting members of the flat cable and the contact sections of the terminals at a high density inside the housing.

On the other hand, a structure might be conceived in which numerous connecting members are located on both sides of the base member of the flat cable and numerous terminals inside the housing are located in two rows in positions corresponding to the respective connecting members on both sides of the flat cable, thus making it possible to reduce the size of the housing and also making it possible to provide connections between the connecting members of the flat cable and the contact sections of the terminals at a high density inside the housing. However, in cases where a structure is used in which connecting members are located on both sides of the base member of the flat cable, the cost of the flat cable is increased.

Furthermore, a structure is also conceivable in which terminals inside the housing are provided in a number of rows, and a plurality of flat cables, each of which has a plurality of connecting members located on one side of the base member in positions corresponding to the terminals of the respective rows, are used.

However, in cases where the number of flat cables mounted in the housing is increased, the mounting of the respective flat cables in a single housing is difficult, so that operability deteriorates.

The present invention was devised in light of the above. The object of the present invention is to provide a low-cost flat cable connector which makes it possible to provide connection between connecting members of a flat cable and electrical terminals at a high density in a limited housing space while reducing the size of the housing and which also offers good operability in the mounting of the flat cable in the housing.

SUMMARY OF THE INVENTION

In order to achieve the abovementioned object, the flat cable connector of the present invention includes a flat cable having a plurality of connecting members located side by side on a flexible sheet base member, a housing having a receiving section that receives a portion of the flat cable on which the plurality of connecting members are located; a plurality of electrical terminals having contract sections exposed inside the receiving section; and a slider member is inserted into the receiving section along with the flat cable and which presses the connecting members against the contact sections of the terminals so that the connecting members and terminals are electrically connected; wherein the flat cable is inserted into the receiving section in a bent state in which the base member is bent at an intermediate point in a direction which is substantially perpendicular to the direction of the row of the plurality of connecting members; and the plurality of terminals are located in respective positions corresponding to the plurality of connecting members of the flat cable inserted into the receiving section in the bent state.

In the flat cable connector of the present invention, a flat cable is used in a bent form in which the cable is bent at an intermediate point in a direction which is substantially perpendicular to the direction of the row of connecting members. Accordingly, a number of connecting members similar to that in cases where connecting members are located on both sides of a single sheet base member can be located side by side on the base member of a prescribed width, i.e., width in a bent form. Furthermore, since connecting members need only be formed on one side of the base member, there is no cost increase as there is in cases where connecting members are located on both sides of the base member. In addition, since a large number of connecting members can be formed on a single base member, the number of flat cables mounted in the housing can be reduced compared to the number required in cases where the same number of connecting members are formed on a plurality of base members. Accordingly, the mounting of the flat cable in a bent form in the housing is far superior.

Furthermore, since the plurality of terminals in the housing are located in positions corresponding to the respective connecting members of the flat cable inserted into the receiving section of the housing in a bent form, the housing can be reduced in size compared to cases where terminals are located in a single row; furthermore, a large number of terminals can be positioned at a high density in a limited space.

Accordingly, the present invention makes it possible to realize a flat cable connector in which the size of the housing can be reduced, in which the connecting members of the flat cable and the terminals can be located at a high density inside a limited housing space, whereby the mounting of the flat cable in the housing is easy, and the connector can be inexpensively manufactured.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
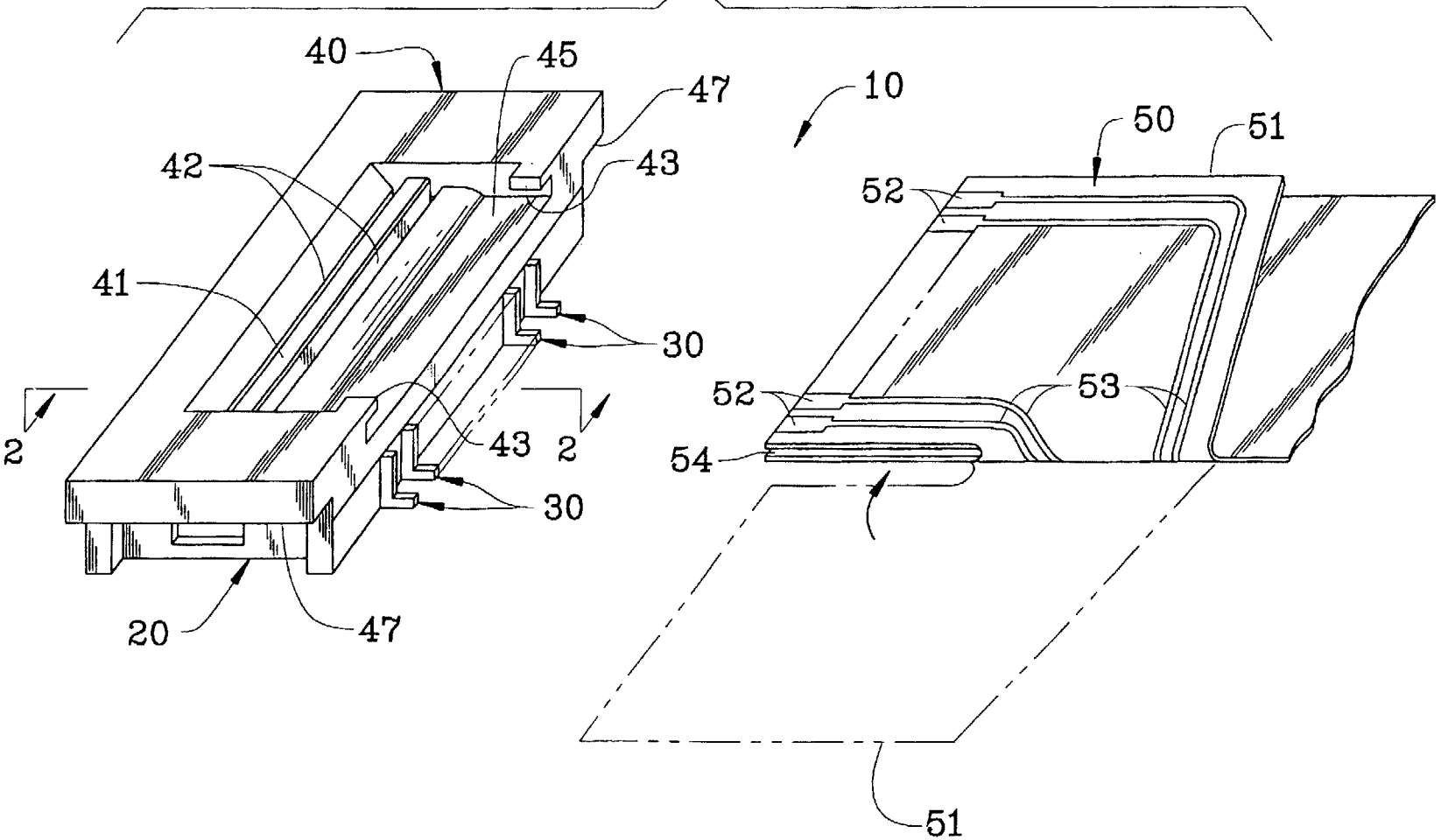
FIG. 1 is an exploded perspective view showing a flat cable connector constructed according to a first embodiment of the present invention and a flat cable to be connected thereto.

As shown in FIG. 1, connector 10 of the present embodiment comprises a housing 20, a plurality of terminals 30 which are accommodated and secured inside the housing 20, a plurality of terminals 30 which are accommodated and secured inside the housing 20, a slider member 40 which is latchably attached to the housing 20, and a flat cable 50 which is plugged into the housing 20 and electrically connected to the terminals 30.

Figure 2:
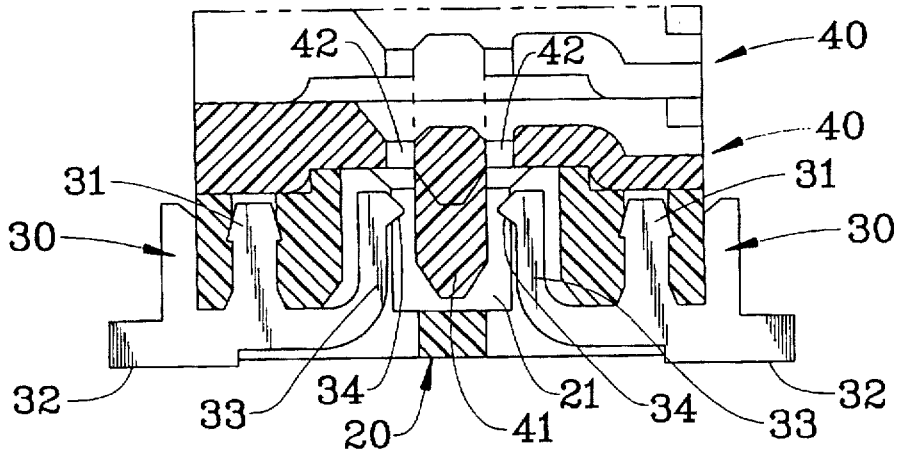
FIG. 2 is a cross-sectional view taken along line 2—2 of FIG. 1.

As shown in FIG. 2, the terminals 30 are installed facing each other on the left and right sides of a cable-receiving section 21 which is formed in the central portion of the housing 20 with respect to the width of the housing 20. Each of the terminals 30 has a fastening member 31 which is fastened in place by being pressed onto the housing 20, a termination member 32 which extends from the bottom end of the fastening member 31 toward the outside of the housing 20 and which is to be connected to a PC board, etc., and a resilient contact member 33 which extends from the bottom end of the fastening member 31 and is bent upwardly into the receiving section 21 of housing 20.

Resilient contact members 33 have contact sections 34 at the free-ends thereof which extend into cable-receiving section 21.

The sliding member 40 has a tongue section 41 which is inserted into the receiving section 21 of the housing 20, and slots 42 for the flat cable 50 which extend substantially parallel to each other along the direction of length of the slider member 40 on the left and right sides of the tongue section 41. Furthermore, the slider member 40 is supported on the housing 20 so that the slider member 40 can move upward and downward between a final or inner position (indicated by the solid lines in FIG. 2) in which the tongue section 41 is inserted into the receiving section 21 of the housing 20, and a preparatory or outer position (indicated by broken lines in FIG. 2) in which the tongue section 41 is withdrawn to the vicinity of the entrance of the receiving section 21. The slider member 40 has opposite end portions 47 which extend beyond side edges of the housing.

Figure 3:
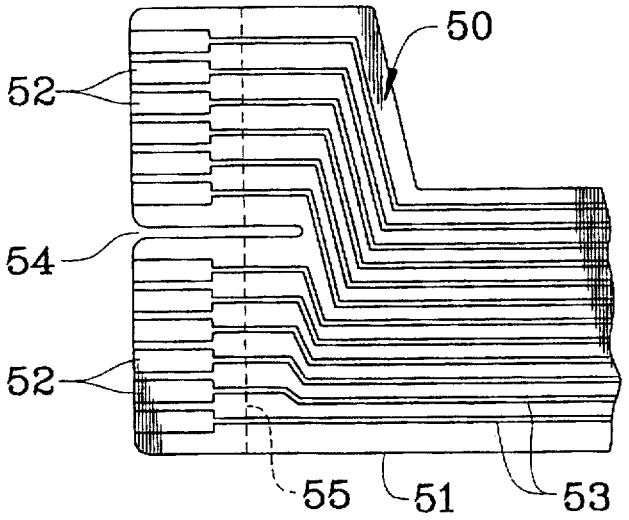
FIG. 3 is a plan view of the flat cable.

As shown in FIG. 3, the cable 50 has a flexible sheet base member 51, a plurality of connecting members 52 which are located at prescribed intervals along the front edge of the front end portion (left end portion in FIG. 3) of the base member 51, and a plurality of circuit paths 53 which extend from the respective connecting members 52. Connecting members 52 can also be defined as conductive pads. The connecting members 52 are formed so that they are wider than the circuit paths 53, and the sheet base member 51 is wider at the front end in order to maintain the spacing of the respective connecting members 52. The portion (on the right side in FIG. 3) on which only circuit paths 53 are located has a narrow width so that a plurality of circuit paths 53 can be closely spaced at a high density. By forming the base member 51 in such a configuration, it is possible to provide numerous connecting members 52 while keeping the overall width of the flat cable 50 narrow, so that the flat cable 50 does not create an obstruction following connection.

Figure 4:
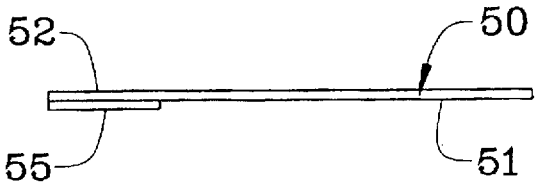
FIG. 4 is a side view of the flat cable.

A slot 54, which extends in a direction that is substantially perpendicular to the direction in which the connecting members 52 are lined up, is located in the central portion with respect to the width of the front end portion of the base member 51. As shown in FIG. 1, the flat cable 50 is constructed to be used in an attitude in which the cable 50 is bent so that the surface on which the connecting members 52 are located is on the outside. Furthermore, as shown in FIG. 4, a reinforcing member 55, which is used to reinforce the front end portion of the flat cable 50 by thickening this front end portion, is bonded to the undersurface of the front end portion of the sheet base member 51.

Figure 5:
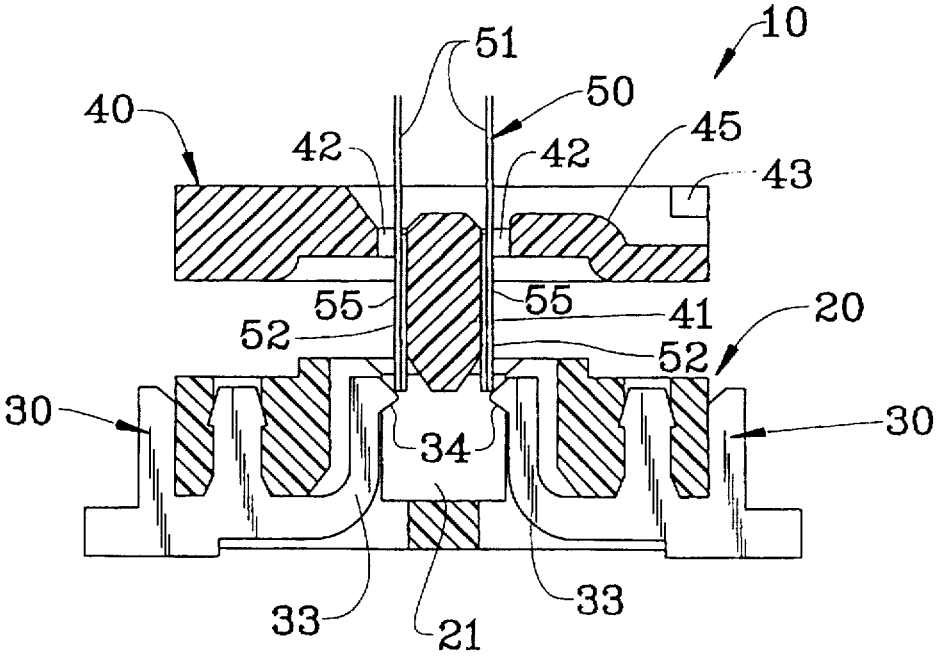
FIG. 5 is a view similar to FIG. 2 showing the flat cable in position in the connector prior to the flat cable being connected thereto.

Next, the procedure to connect the flat cable 50 to connector 10 will be described with reference to FIGS. 5 and 6.

First, as shown in FIG. 1, the flat cable 50 is bent along the slot 54. Next, as shown in FIG. 5, one section of the base member 51 (which is bent so that the base member is folded in two) is inserted into one of the two slots 42 of the slider member 40 (which is in its preparatory or outer position), and the other section of the base member 51 is inserted into the other slot 42, so that the flat cable 50 is positioned along respective sides of tongue section 41.

Figure 6:
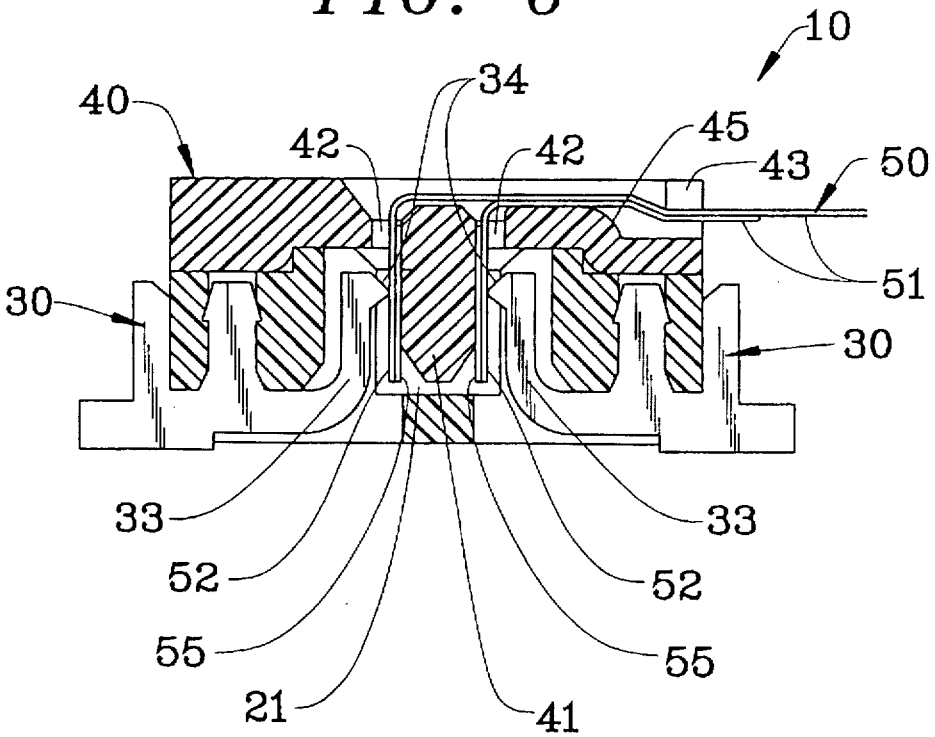
FIG. 6 is a view similar to FIG. 5 showing the flat cable connected to the connector.

Then, as shown in FIG. 6, the slider member 40 is moved to its final position, so that the tongue section 41 of the slider 40 and the front end portion of the flat cable 50 lying along respective sides of the tongue section 41 are inserted into the receiving section 21 of the housing 20 together. The connecting members 52 lined up along the front end portion of the flat cable 50 that is inserted into the receiving section 21 together with the tongue section 41 of the slider member 40 are pressed by the tongue section 41 of the slider member 40 so that the respective connecting members 52 are electrically connected with the contact sections 34 of resilient contact members 33 of the terminals 30 located in positions corresponding to the connecting members 52.

After the slider member 40 has been moved into its final position, the portion of the flat cable 50 extending outwardly from the top of the slider member 40 is bent to the right and placed in a recess 45 in the slider member (as shown in FIG. 6) so that the cable 50 does not create an obstruction. Moreover, side edges of the flat cable 50 are positioned under projections 43 (see FIG. 1) which are located on the slider member 40.

In the connector 10 of the present embodiment, the flat cable 50 can be mounted in the housing 20 from above the housing 20; accordingly, the flat cable connecting operation can easily be performed.

Next, a second embodiment of the present invention will be described.

Figure 7:
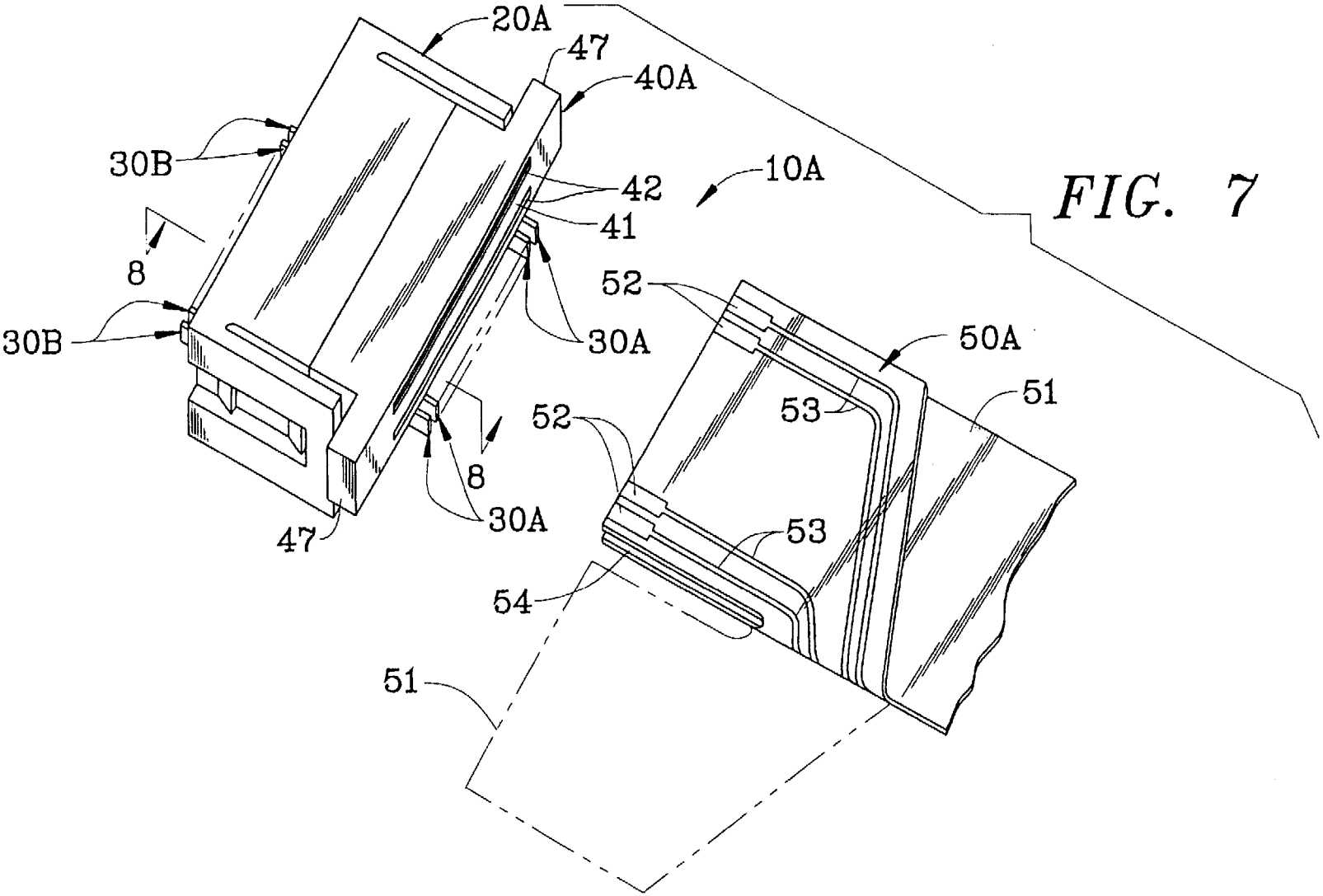
FIG. 7 is an exploded perspective view showing a flat cable connector constructed according to a second embodiment of the present invention.

As is shown in FIG. 7, the connector 10A of this embodiment comprises a housing 20A, two types of terminals 30A and 30B which are accommodated and secured inside the housing 20A, a slider member 40A which is latchably attached to the housing 20A, and a flat cable 50A which is positioned in the housing 20A and electrically connected with the terminals 30A.

Figure 8:
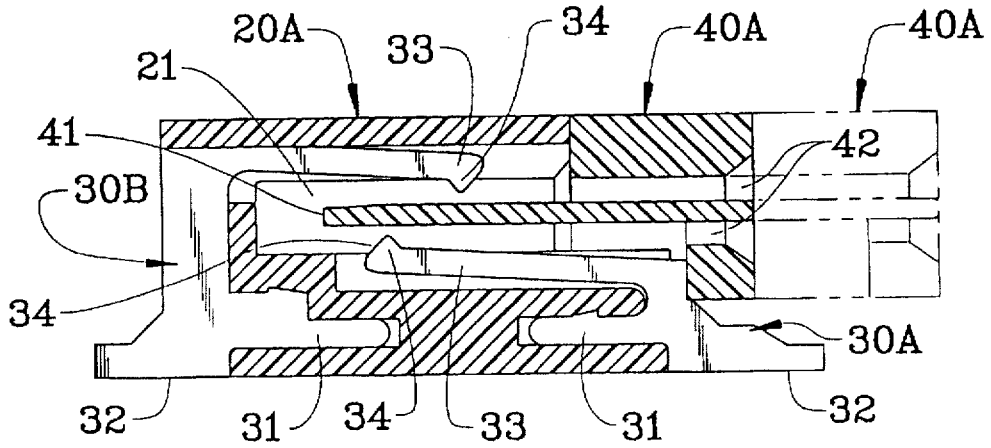
FIG. 8 is a cross-sectional view taken along line 8—8 of FIG. 7.

As is shown in FIG. 8, the plurality of terminals 30A are installed in the right-side portion of the housing 20A at prescribed intervals along the direction of length of the housing 20A (i.e., the direction perpendicular to the surface of the page). Each of the terminals 30A has a fastening member 31 which is fastened in place by being pressed into a slot in the housing 20A from the right-side of the housing 20A, a termination member 32 which extends toward the outside on the right of the housing 20A from the fastening member 31, and which is connected to a PC board, etc., and a resilient contact member 33 which extends into and along the lower side of the receiving section 21 inside the housing 20A from the fastening member 31.

The plurality of terminals 30B of the other type are installed in the left-side of the housing 20A at prescribed intervals along the direction of length of the housing 20A. Each of these terminals 30B has a fastening member 31 which if fastened in place by being pressed into a slot in the housing 20A from the left-side of the housing 20A, a termination member 32 which extends toward the outside on the left of the housing 20A from the fastening member 31 and which is connected to a PC board, etc., and a resilient contact member 33 which extends into and along the upper side of receiving section 21.

The slider member 40A has a tongue section 41 which is inserted into the cable-receiving section 21 of the housing 20A and slots 42 for the flat cable 50A which extend substantially parallel to each other along the direction of length of the slide member 40 on the upper and lower sides of the tongue section 41. Furthermore, the slider member 40A is supported on the housing 20A so that the slider member 40A can move to the left and right between a final or inner position (indicated by the solid lines in FIG. 10) in which the tongue section 41 is inserted into the receiving section 21 of the housing 20A, and a preparatory or outer position (indicated by the broken lines in FIG. 8 and the solid lines in FIG. 9) in which the tongue section 41 is withdrawn to the vicinity of the entrance of the receiving section 21. In the final position, the slider is received in a cutout 26 in an upper side of the housing 20A.

The construction of the flat cable 50A is similar to that of the flat cable 50 shown in FIGS. 3 and 4; accordingly, the respective elements of the flat cable 50A are labeled with the same symbols, and a detailed description is omitted here.

Figure 9:
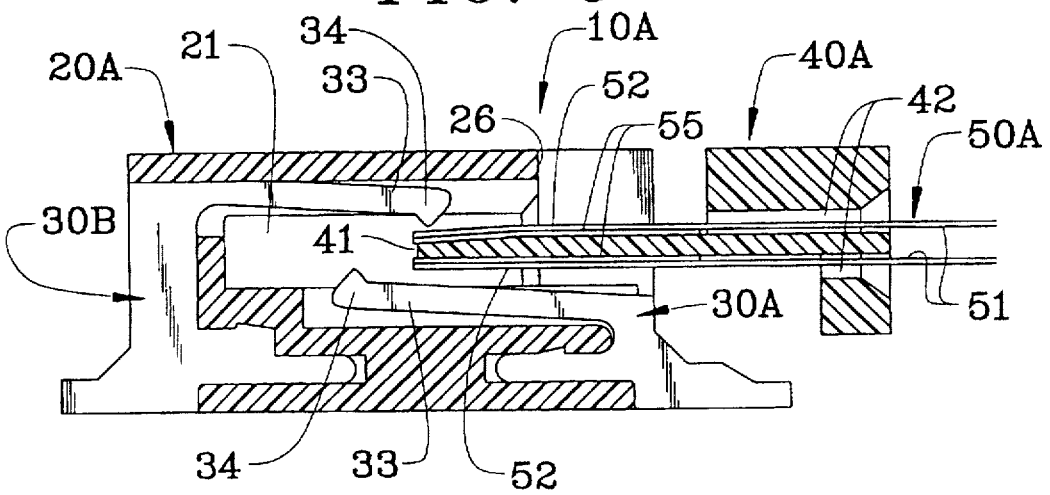
FIG. 9 is a view similar to FIG. 8 showing the flat cable in position prior to being connected to the connector.

Next, the procedure to connect the flat cable 50A in the housing 20A will be described with reference to FIGS. 9 and 10 which illustrate the procedure to connect the flat cable 50A in the housing 20A. FIG. 9 shows the flat cable 50A positioned on the slider member 40A which is in its preparatory position, while FIG. 10 shows the completed connection of the flat cable 50A in the housing 20A.

First, as in the case of the flat cable 50, the flat cable 50A is bent along the slot 54. Next, as shown in FIG. 9, one section of the base member 51, which is bent so that the base member is folded in two, is inserted into one of the two slots 42 of the slider member 40A (which is in its preparatory position), and the other section of the base member 51 is inserted into the other slot 42, so that the folded over sections of the flat cable 50A extend along respective sides of the tongue section 41.

Figure 10:
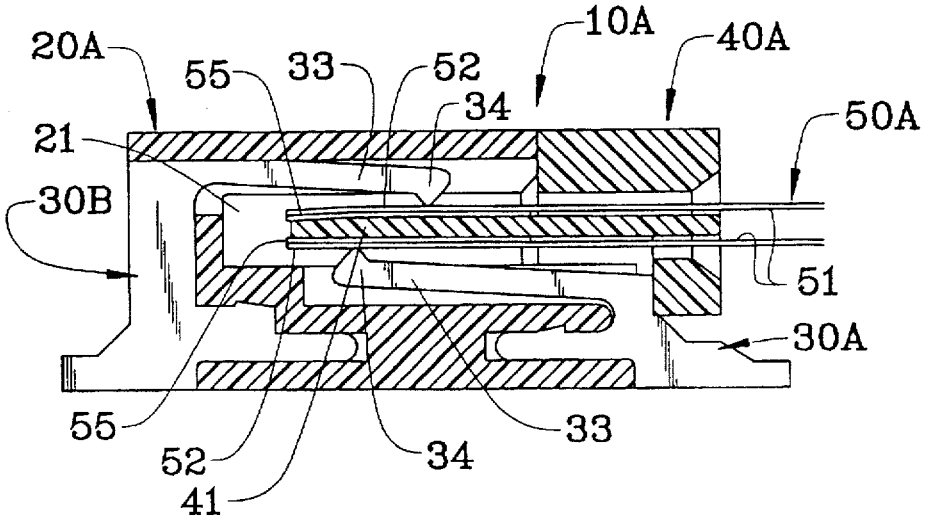
FIG. 10 is a view similar to FIG. 9 showing the flat cable connected to the connector.

Then, as shown in FIG. 10, the slider member 40A is moved to its final position, so that the tongue section 41 of the slider member 40A and the front end portion of the flat cable 50A lying along the tongue section 41 are inserted into the receiving section 21 of the housing 20A together. The plurality of connecting members 52 lined up along the front end portion of the flat cable 50A that is inserted into the receiving section 21 together with the tongue section 41 of the slider member 40A are pressed by the tongue section 41 so that the respective connecting members 52 are electrically connected with contact sections 34 of resilient contact members 33 of the terminals 30A and 30B installed in positions along the receiving section 21 corresponding to the connecting members 52.

Furthermore, it would also be possible to insert the flat cable 50A into the receiving section 21 of the housing 20A first, and then to move the slider member 40A from its preparatory position into its final position so that the tongue section 41 is inserted into its final position so that the tongue section 41 is inserted into the receiving section.

In the connector 10A, the flat cable 50A extends out from the front of the housing 20A; accordingly, even without any special treatment, the flat cable 50A is prevented from creating an obstruction, so that there is no need to bend the flat cable 50A at an intermediate point as in the case of the flat cable 50. Thus, there is no danger of damage to the circuit paths 53.

Embodiments of the present invention have been described above; however, the present invention is not limited to the concrete configurations of such embodiments. For example, in the embodiments described above, the flat cable was constructed so as to be folded in a manner which placed the surface on which the connecting members were formed on the outside of the folded flat cable, and the terminals inside the housing were constructed so that the contact sections of the resilient contact members were positioned on the outside of the folded flat cable inserted into the housing. However, it would also be possible to construct the flat cable so that the flat cable is folded in a manner which places the surface on which the connecting members are formed on the inside of the folded flat cable and to construct the terminals inside the housing so that the contact sections of the resilient contact members are positioned on the inside of the folded flat cable inserted into the housing. In such a case, two slider tongue sections are located in positions which allow the tongue sections to clamp the folded cable from both sides.

I claim:

1. A flat cable connector for electrical interconnections of high density parallel conductors on one surface of a flexible cable and a circuit board, comprising:

the flexible cable having a wider termination end formed with conductive pads which are connected to respective ones of the parallel conductors, and a slot at a substantially center portion of the termination end to provide a pair of termination end portions to be folded over along the slot;

a housing having a plurality of terminals in two rows secured therein, the terminals having termination sections to be soldered to the circuit board and resilient contact members; and a slider having a pair of parallel slots and a tongue located between the parallel slots, the slider having an outer surface and a recess in the outer surface extending perpendicular to the parallel slots;

wherein the termination end portions of the flexible cable are inserted into the parallel slots in the slider for being inserted between the resilient contact members of the two rows of terminals while locating the tongue of the slider between the folded termination end portions of the flexible cable, and the flexible cable can be bent adjacent to the termination end portions so that the flexible cable is received in the recess and extends perpendicular to the parallel slots.

2. A flat cable connector as claimed in claim 1, wherein said terminals have fastening members for securing the terminals to the housing.

3. A flat cable connector as claimed in claim 1, wherein the termination end portions of the cable are inserted into the parallel slots in the slider in a direction extending perpendicular to the termination sections of the terminals.

4. A flat cable connector as claimed in claim 1, wherein the termination end portions of the cable are inserted into the parallel slots in the slider in a direction extending parallel to the termination sections of the terminals.

5. A flat cable connector as claimed in claim 1, wherein the terminals are mounted in said housing from a bottom surface thereof.

6. A flat cable connector as claimed in claim 1, wherein the terminals are mounted in said housing from respective opposite sides thereof.

7. A flat cable connector as claimed in claim 1, wherein the slider has projections under which side edges of the flexible cable can be positioned to secure the flexible cable in the recess.

8. A flat cable connector for electrical interconnections of high density parallel conductors on one surface of a flexible cable and a circuit board, comprising:

the flexible cable having a wider termination end formed with conductive pads which are connected to respective ones of the parallel conductors, and a slot at a substantially center portion of the termination end to provide a pair of termination end portions to be folded over along the slot;

a housing having a plurality of terminals in two rows secured therein, the terminals having termination sections to be soldered to the circuit board and resilient contact members; and a slider having a pair of parallel slots and a tongue located between the parallel slots, the slider being movable parallel to the circuit board into a cutout in an upper side of the housing;

wherein the termination end portions of the flexible cable are inserted into the parallel slots in the slider for being inserted between the resilient contact members of the two rows of terminals while locating the tongue of the slider between the folded termination end portions of the flexible cable.

9. A flat cable connector as claimed in claim 8, wherein opposite end portions of the slider extend beyond respective side walls of the housing.

* * * * *